US010632597B2

(12) United States Patent
Chen

(10) Patent No.: US 10,632,597 B2
(45) Date of Patent: Apr. 28, 2020

(54) FOLDABLE HANDLE FOR A HAND TOOL

(71) Applicant: Yi-Fu Chen, Taichung (TW)

(72) Inventor: Yi-Fu Chen, Taichung (TW)

( * ) Notice: Subject to any disclaimer, the term of this patent is extended or adjusted under 35 U.S.C. 154(b) by 118 days.

(21) Appl. No.: 16/019,547

(22) Filed: Jun. 27, 2018

(65) Prior Publication Data

US 2020/0001441 A1 Jan. 2, 2020

(51) Int. Cl.

| | |
|---|---|
| ***B25B 23/00*** | (2006.01) |
| ***B25G 1/06*** | (2006.01) |
| ***B25B 23/16*** | (2006.01) |
| ***B25B 13/46*** | (2006.01) |

(52) U.S. Cl.

CPC ..... *B25B 23/0028* (2013.01); *B25B 23/16* (2013.01); *B25G 1/066* (2013.01); *B25B 13/46* (2013.01)

(58) Field of Classification Search

CPC ..... B25B 23/0028; B25B 23/16; B25B 13/46; B25G 1/066

USPC ..... 81/177.6, 177.5

See application file for complete search history.

(56) References Cited

U.S. PATENT DOCUMENTS

| | | | | |
|---|---|---|---|---|
| 6,401,576 | B1 * | 6/2002 | Wu | B25G 1/066 81/177.4 |
| 7,197,965 | B1 * | 4/2007 | Anderson | B25B 13/481 81/177.9 |
| 7,237,463 | B1 * | 7/2007 | Lee | B25G 1/063 81/177.7 |
| 7,866,235 | B2 * | 1/2011 | Hi | B25G 1/085 81/177.7 |
| 8,869,658 | B2 * | 10/2014 | Chou | B25G 1/007 403/322.4 |

* cited by examiner

*Primary Examiner* — Hadi Shakeri

(57) ABSTRACT

A foldable handle includes a connection section and a grip section. A recess is defined in the connection section and a function part is located in the recess. A restriction unit extends through the connection section to pivotably connect the function part to the connection section. The restriction unit is operated to restrict the function part to be co-axial with the handle, or to restrict the function part to be an angle relative to the handle. The function part includes a neck received in the recess so as to make the foldable handle be compact for convenience of storage.

5 Claims, 7 Drawing Sheets

FOLDABLE HANDLE FOR A HAND TOOL

BACKGROUND OF THE INVENTION

1. Fields of the Invention

The present invention relates to a foldable handle, and more particularly, to a foldable handle of a hand tool.

2. Descriptions of Related Art

A T-shaped tool includes a handle and a rod which perpendicularly extending from the middle portion of the handle. A driving portion is connected to the distal end of the rod, so that when the user holds the handle and rotates the T-shaped tool, the T-shaped tool can tighten or loosen a bolt or the like. However, the conventional T-shaped tool occupies too much space and is not convenient for storage. Some of the T-shaped tools are improved to include a pivotable portion so that the tool can be foldable. Nevertheless, the pivotable portion lacks a proper restriction feature and the T-shaped tool is not stable when outputting a torque.

The present invention is intended to provide a foldable handle that has a limitation feature to eliminate the drawbacks mentioned above.

SUMMARY OF THE INVENTION

The present invention relates to a foldable handle and comprises a connection section and a grip section. A recess is defined in the connection section and defined between a first sidewall, a second sidewall and an inner bottom formed between the first and second sidewalls. The recess includes a radial opening and an axial opening which communicates with the radial opening. The axial opening is located opposite to the grip section. The connection section includes a passage defined through the first sidewall and communicates with the recess. A bore is defined through the second sidewall and communicates with the recess. The passage is located corresponding to the bore. A function part includes an installation end and a connection portion respectively formed on two ends thereof, and a neck is formed between the installation end and the connection portion. The installation end is located in the recess and has a through hole and a restriction hole. The through hole is located corresponding to the bore, and the restriction hole is located corresponding to the passage. The through hole communicates with the restriction hole.

A restriction unit has a restriction member, a connector and a resilient member. The restriction member includes a restriction section. The connector includes a connection end and a head respectively formed on two ends thereof. The connection end extends through the bore and is connected to the restriction member. The resilient member is mounted to the connector and biased between the head and the connection section. The resilient member pushes the head of the connector to move the restriction section of the restriction member to be located in the restriction hole of the installation end to restrict the function part from pivoting relative to the handle. Alternatively, the resilient member is compressed by the head of the connector to remove the restriction section of the restriction member out from the restriction hole of the installation end so that the function part is pivotable relative to the handle.

Preferably, the restriction member includes a rod and a flange respectively formed on two ends of the restriction section. The rod extends through the through hole of the function part and includes a threaded hole. The connection end includes outer threads which are connected to the threaded hole. The flange contacts outside of the connection section.

Preferably, the connection section includes a stepped recess defined in the outside thereof. The stepped recess communicates with the bore. One end of the resilient member is engaged with the stepped recess.

Preferably, the first sidewall includes a first inside through which the passage is defined. The second sidewall includes a second inside through which the bore is defined. The installation end includes two installation faces, and the through hole and the restriction hole are respectively defined through the two installation faces. The first and second insides of the connection section respectively contact the two installation faces.

Preferably, the first sidewall includes a first contact face which is located close to the axial opening. The second sidewall includes a second contact face which is located close to the axial opening. The neck includes a matching face. When the function part is pivoted to be co-axial with the handle, the matching face is located within the recess and contacts the first contact face, the second contact face and the inner bottom.

Preferably, the first sidewall includes a first transit face which is formed between the first inside and the first contact face. The second sidewall includes a second transit face which is formed between the second inside and the second contact face. The function part includes two yielding faces and each yielding face is formed between the installation face and the matching face corresponding thereto. When the neck is pivoted to be co-axial with the handle, the yielding faces are not in contact with the first and second transit faces to reduce friction between the neck of the function part and first and second sidewalls of the recess when pivoting the neck relative to the recess.

Preferably, the passage and the bore are located close to the grip section. The first and second contact faces are located remote from the grip section. The distance between the first and second insides is smaller than the distance between the first and second contact faces.

Preferably, the passage and the restriction hole both are a hexagonal hole. The restriction section of the restriction member includes a hexagonal cross section which is movably inserted into the passage and the restriction hole.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
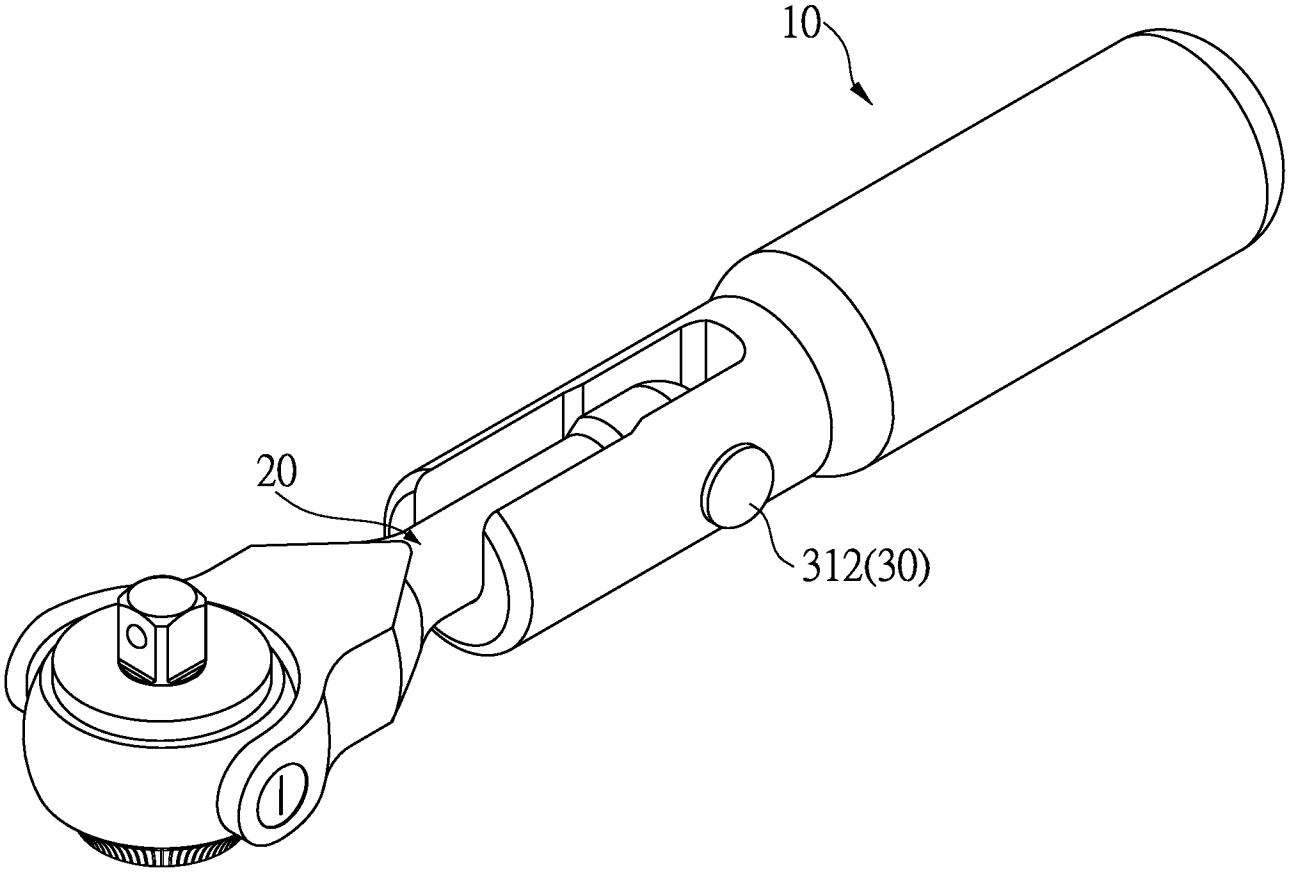
FIG. 1 is a perspective view to show the foldable handle of the present invention.
Figure 2:
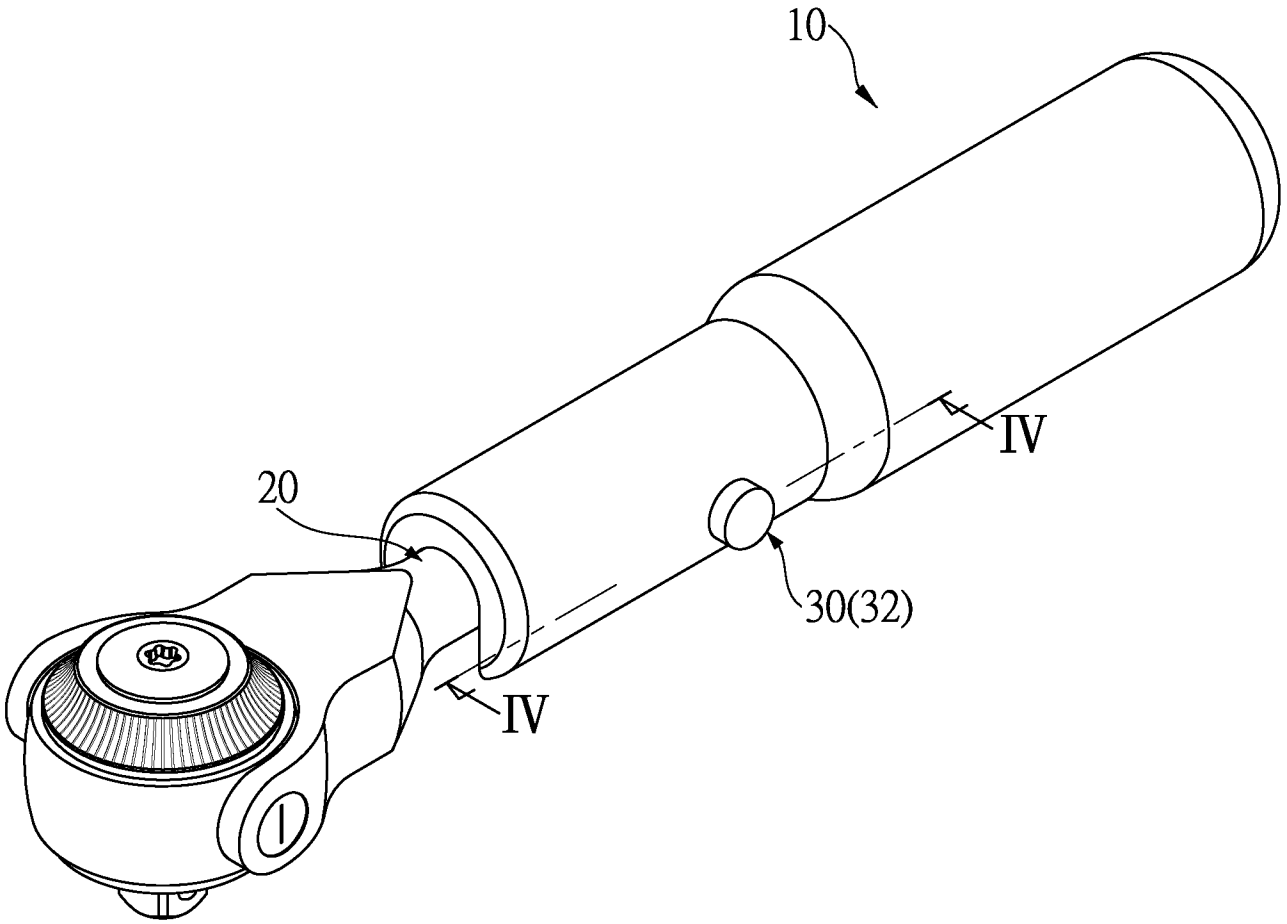
FIG. 2 is another perspective view to show the foldable handle of the present invention.
Figure 3:
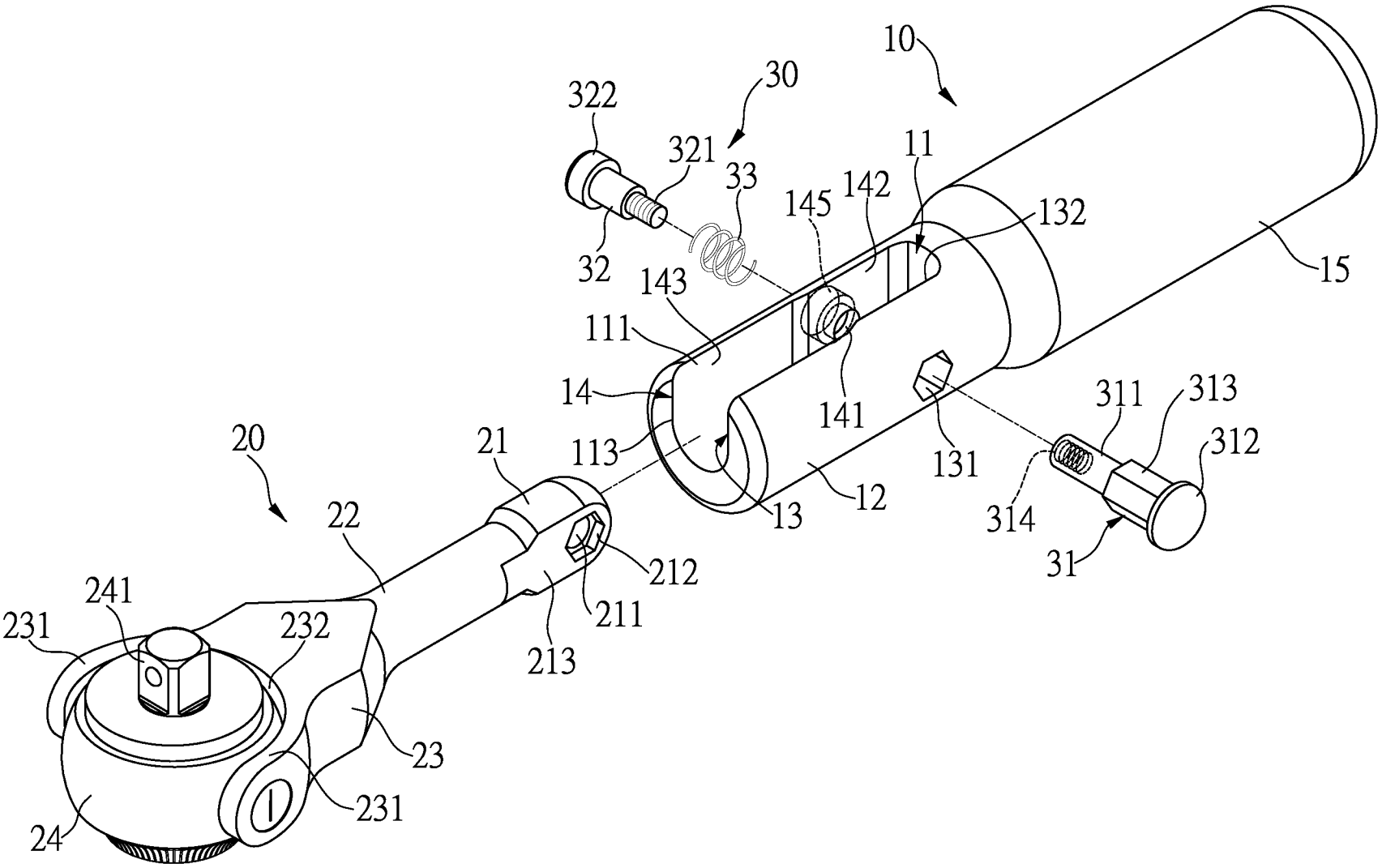
FIG. 3 is an exploded view of the foldable handle of the present invention.

Referring to FIGS. 1 to 6, the foldable handle 10 of the present invention comprises a connection section 12 and a grip section 15 which shares a common axis with the connection section 12. A recess 11 is defined in the connection section 12 and is defined between a first sidewall 13, a second sidewall 14 and an inner bottom 112 formed between the first and second sidewalls 13, 14. The recess 11 includes a radial opening 111 and an axial opening 113 which communicates with the radial opening 111. The axial opening 113 is located opposite to the grip section 15. The connection section 12 further includes a passage 131 defined through the first sidewall 13 and communicates with the recess 11. A bore 141 is defined through the second sidewall 14 and communicates with the recess 11. Specifically, the first sidewall 13 includes a first inside 132 through which the passage 131 is defined. The second sidewall 14 includes a second inside 142 through which the bore 141 is defined. The passage 131 is located corresponding to the bore 141. The passage 131 and the bore 141 are located close to the grip section 15. The connection section 12 further includes a stepped recess 145 defined in the outside thereof, and the stepped, recess 145 communicates with the bore 141. The first sidewall 13 further includes a first contact face 133 which is located close to the axial opening 113. The second sidewall 14 further includes a second contact face 143 which is located close to the axial opening 113. That is to say, the first and second contact faces 133, 143 are located remote from the grip section 15. The first sidewall 13 includes a first transit face 134 which is formed between the first inside 132 and the first contact face 133. The second sidewall 14 includes a second transit face 144 which is formed between the second inside 142 and the second contact face 143. The distance between the first and second insides 132, 142 is smaller than the distance between the first and second contact faces 133, 143.

A function part 20 includes an installation end 21 and a connection portion 23 respectively formed on two ends thereof, and a neck 22 is formed between the installation end 21 and the connection portion 23. The installation end 21 is located in the recess 11 and has a through hole 211 and a restriction hole 212. The through hole 211 is located corresponding to the bore 141. The restriction hole 212 is located corresponding to the passage 131. The through hole 211 communicates with the restriction hole 212. The passage 131 and the restriction hole 212 both are a hexagonal hole. The installation end 21 includes two installation faces 213. The through hole 211 and the restriction hole 212 are respectively defined through the two installation faces 213. The first and second insides 132, 142 of the connection section 12 respectively contact the two installation faces 213. The neck 22 includes a matching face 221. The function part 20 includes two yielding faces 222 and each yielding face 222 is formed between the installation face 213 and the matching face 221 corresponding thereto. The connection portion 23 includes two lugs 231 extending therefrom, and an installation recess 232 is defined between the two lugs 231. A driving head 24 is pivotably connected between the two lugs 231. A driving portion 241 extends from one side of the driving head 24.

A restriction unit 30 includes a restriction member 31, a connector 32 and a resilient member 33, The restriction member 31 includes a restriction section 313, and a rod 311 and a flange 312 are respectively formed on two ends of the restriction section 313. The restriction section 313 includes a hexagonal cross section so as to be movably inserted into the passage 131 and the restriction hole 212. A threaded hole 314 is defined in the distal end of the rod 311 of the restriction member 31. The rod 311 extends through passage 131 in the first sidewall 13 and the through hole 211 of the function part 20.

The connector 32 includes a connection end 321 and a head 322 respectively formed on two ends thereof. The resilient member 33 is mounted to the connector 32 and biased between the head 322 and the stepped recess 145 of the connection section 12. The connection end 321 extends through the bore 141 and includes outer threads which are connected to the threaded hole 314 of the restriction member 31. The flange 312 contacts outside of the connection section 12.

Figure 4:
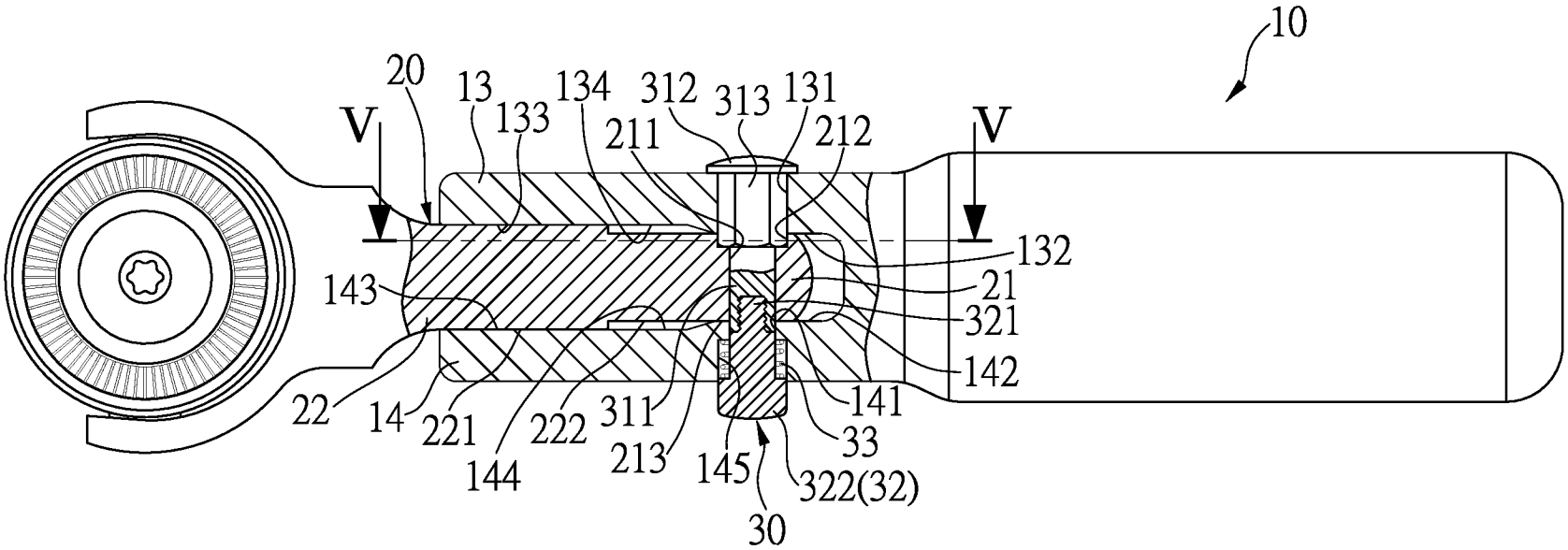
FIG. 4 is a cross sectional view, taken along line IV-IV of FIG. 2.
Figure 5:
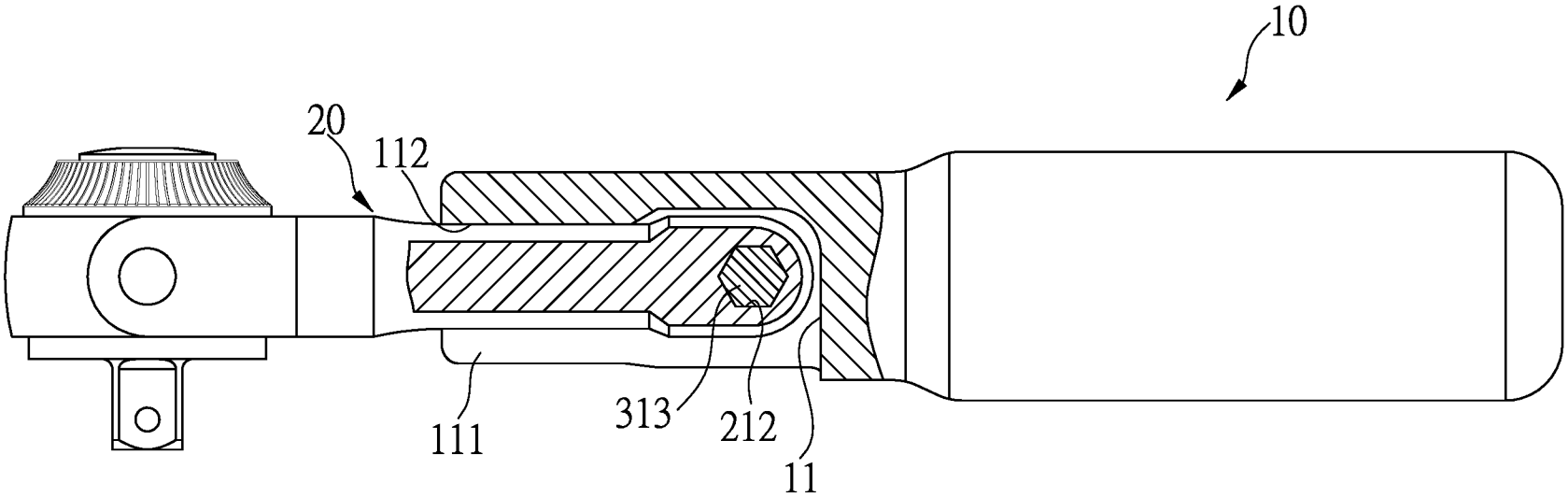
FIG. 5 is a cross sectional view, taken along line V-V of FIG. 4.

As shown in FIGS. 4 and 5, when the function part 20 is pivoted to be co-axial with the handle 10, the function part 20 is used as a general hand tool, and the user may hold the grip portion 15 to operate the driving head 24. The matching face 221 is located within the recess 11 and contacts the first contact face 133, the second contact face 143 and the inner bottom 112. The yielding faces 222 are not in contact with the first and second transit faces 134, 144 to reduce friction between the neck 22 of the function part 20 and first and second sidewalls 13, 14 of the recess 11 when pivoting the neck 22 relative to the recess 11. Under this status, the resilient member 33 pushes the head 322 of the connector 32 to move the restriction section 313 of the restriction member 31 to be located in the restriction hole 212 of the installation end 21 to restrict the function part 20 from pivoting relative to the handle 10. Therefore, the function part 20 can be used to output a torque to tighten or loosen an object such as a bolt.

Figure 6:
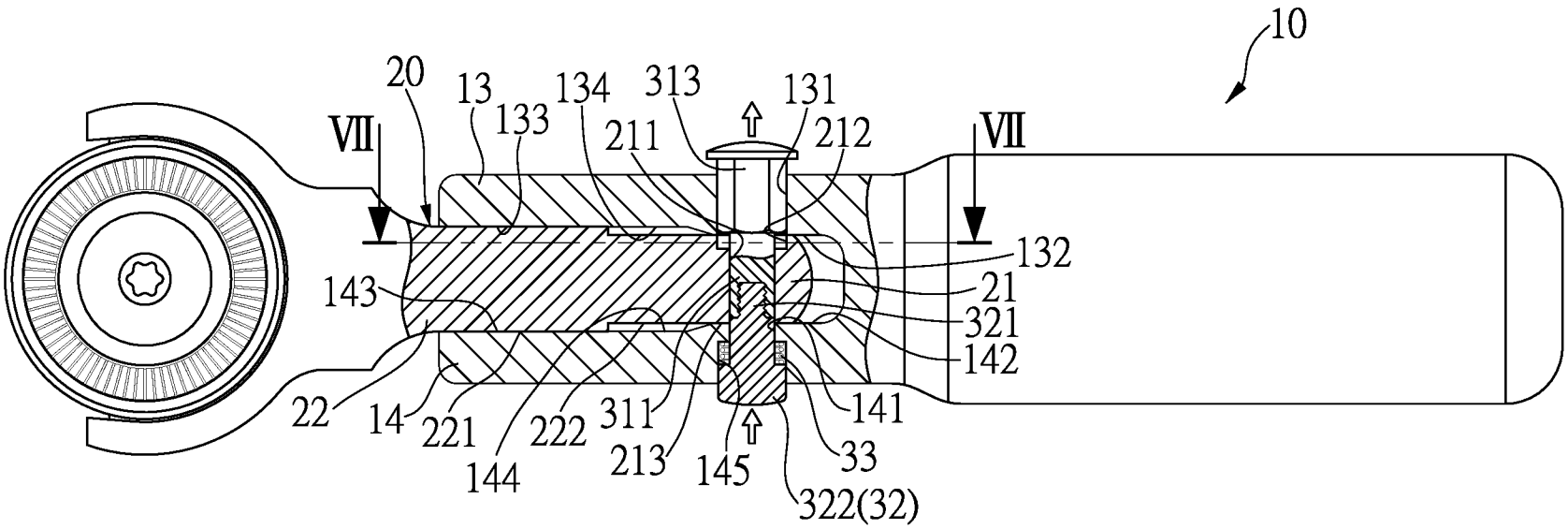
FIG. 6 shows that the connector is pushed to remove the restriction member from the restriction hole, and the function part is pivotable relative to the handle.
Figure 7:
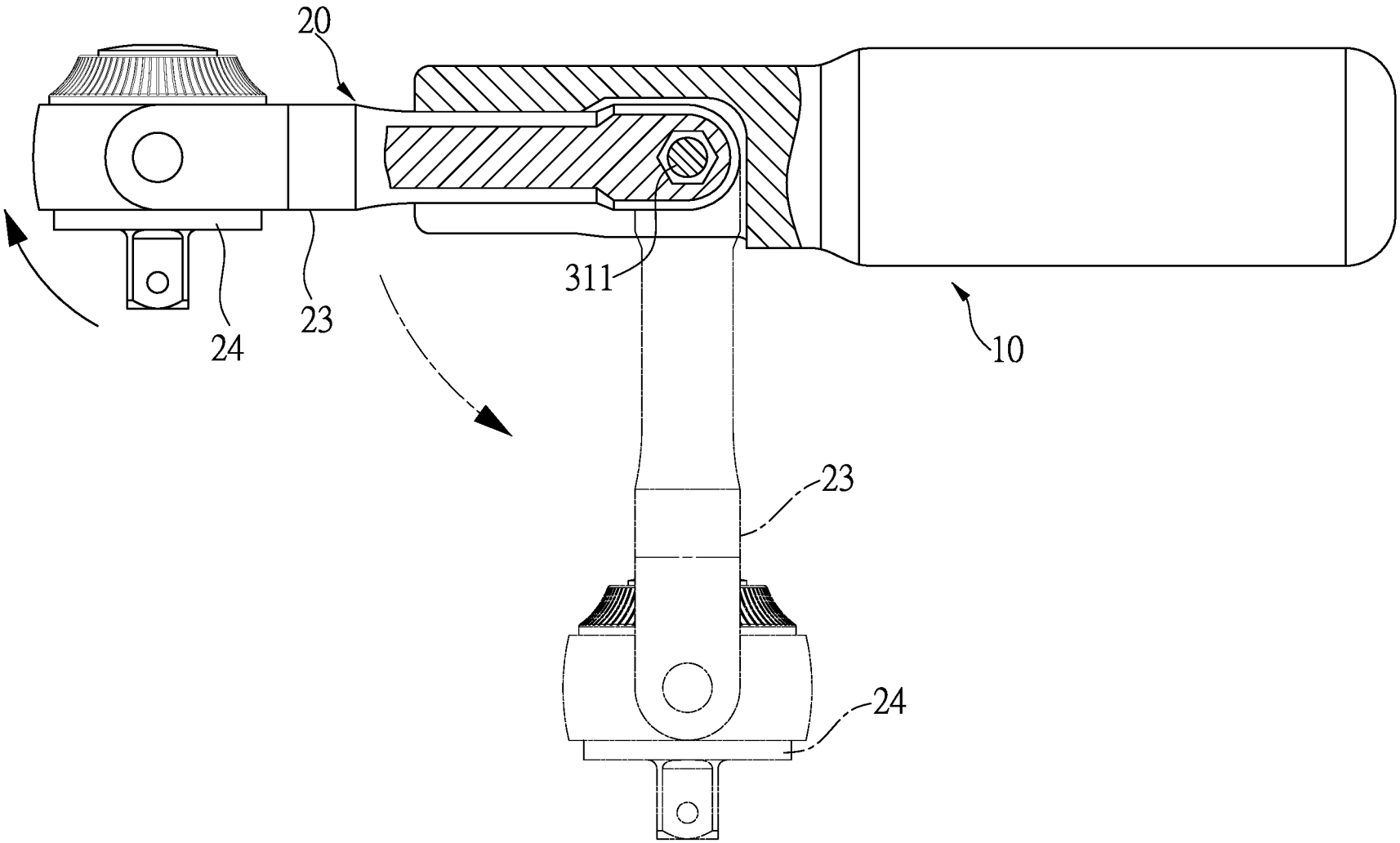
FIG. 7 is a cross sectional view, taken along line VII-VII of FIG. 6, and the function part is pivoted relative to the handle.

When the resilient member 33 is compressed by the head 322 of the connector 32 as shown in FIG. 6, the restriction section 313 of the restriction member 31 is pushed out from the restriction hole 212 of the installation end 21 so that the function part 20 is pivotable relative to the handle 10. When the function part 20 is pivoted to a position to be perpendicular to the handle 10, as shown in FIG. 7, the head 322 of the connector 32 is released, and the resilient member 33 again pushes the head 322 of the connector 32, and the restriction section 313 of the restriction member 31 is moved to be engaged with the restriction hole 212 of the installation end 21 so that the function part 20 cannot be pivotable relative to the handle 10. The hand tool is used as a T-bar as shown in FIG. 7.

While we have shown and described the embodiment in accordance with the present invention, it should be clear to those skilled in the art that further embodiments may be made without departing from the scope of the present invention.

What is claimed is:

1. A foldable handle comprising:

a connection section and a grip section, a recess defined in the connection section and defined between a first sidewall, a second sidewall and an inner bottom formed between the first and second sidewalls, the recess including a radial opening and an axial opening, which communicates with the radial opening, the axial opening located opposite to the grip section, the first sidewall including a first inside, the second sidewall including a second inside, the connection section including a passage defined through the first inside of the first sidewall and communicating with the recess, a bore defined through the second inside of the second sidewall and communicating with the recess, the passage located corresponding to the bore, the first sidewall including a first contact face which is located close to the axial opening, the first sidewall including a first transit face which is formed between the first inside and the first contact face, the second sidewall including a second contact face which is located close to the axial opening, the second sidewall includes a second transit face which is formed between the second inside and the second contact face;

a function part having an installation end and a connection portion respectively formed on two ends thereof, a neck formed between the installation end and the connection portion, the neck including a matching face, the installation end located in the recess and including two installation faces, the installation end having a through hole and a restriction hole respectively defined through the two installation faces, the through hole located corresponding to the bore, the restriction hole located corresponding to the passage, the through hole communicating with the restriction hole, the function part including two yielding faces and each yielding face formed between the installation face and the matching face corresponding thereto, the first and second insides of the connection section respectively contacting the two installation faces, when the function part is pivoted to be co-axial with the handle, the matching face is located within the recess and contacts the first contact face, the second contact face and the inner bottom, when the neck is pivoted to be co-axial with the handle, the yielding faces are not in contact with the first and second transit faces to reduce friction between the neck of the function part and first and second sidewalk of the recess when pivoting the neck relative to the recess, and a restriction unit having a restriction member, a connector and a resilient member, the restriction member including a restriction section, the connector including a connection end and a head respectively formed on two ends thereof, the connection end extending through the bore and connected to the restriction member, the resilient member mounted to the connector and biased between the head and the connection section, the resilient member pushing the head of the connector to move the restriction section of the restriction member to be located in the restriction hole of the installation end to restrict the function part from pivoting relative to the handle, the resilient member being compressed by the head of the connector to remove the restriction section of the restriction member out from the restriction hole of the installation end so that the function part is pivotable relative to the handle.

2. The foldable handle as claimed in claim 1, wherein the restriction member includes a rod and a flange respectively formed on two ends of the restriction section, the rod extends through the through hole of the function part and includes a threaded hole, the connection end includes outer threads which are connected to the threaded hole, the flange contacts outside of the connection section.

3. The foldable handle as claimed in claim 2, wherein the connection section includes a stepped recess defined in the outside thereof, the stepped recess communicates with the bore, one end of the resilient member is engaged with the stepped recess.

4. Foldable handle as claimed in claim 1, wherein the passage and the bore are located close to the grip section, the first and second contact faces are located remote from the grip section, a distance between the first and second insides is smaller than a distance between the first and second contact faces.

5. The foldable handle as claimed in claim 1, wherein the passage and the restriction hole both are a hexagonal hole, the restriction section of the restriction member includes a hexagonal cross section which is movably inserted into the passage and the restriction hole.

* * * * *